United States Patent [19]

Bartholomew

[11] 4,062,452

[45] Dec. 13, 1977

[54] DOCUMENT FILING APPARATUS

[75] Inventor: Allan E. Bartholomew, North Canton, Ohio

[73] Assignee: Kole Enterprises, Inc., Miami, Fla.

[21] Appl. No.: 701,132

[22] Filed: June 30, 1976

[51] Int. Cl.[2] ..... A47F 7/00

[52] U.S. Cl. ..... 211/55; 211/45

[58] Field of Search ..... 211/55, 50, 45, 128

[56] References Cited

U.S. PATENT DOCUMENTS

| | | | |
|---|---|---|---|
| 792,427 | 6/1905 | Knudsen | 211/55 |
| 1,156,401 | 10/1915 | Hawley | 211/55 |
| 2,879,899 | 3/1959 | Shenkin | 211/55 |
| 2,909,287 | 10/1959 | Galassi | 211/55 |
| 3,515,283 | 6/1970 | Poteat | 211/55 |
| 3,750,892 | 8/1973 | Grosse | 211/128 |

FOREIGN PATENT DOCUMENTS

| | | | |
|---|---|---|---|
| 984,962 | 3/1951 | France | 211/55 |

*Primary Examiner*—Marion Parsons, Jr.
*Assistant Examiner*—Robert W. Gibson, Jr.

[57] ABSTRACT

A filing assembly includes a plurality of thin box-like receptacles which are open at the top for storage of paper and the like and have mechanical interlocking means on the front and back. Each receptacle has an angulated or inclined back lower wall. The thin receptacle may be arranged on a wall in a vertical stacked row. The receptacles are in overlapping face-to-face relationship with the mechanical interlocking means engaged and the lower inclined wall engages the wall and serves to tilt the receptacles outwardly and increases the visibility and accessibility of the open tops. Each receptacle in the row is supported by the preceding receptacle of the row. The interlocked receptacles may be also interlocked and placed on a horizontal surface for developing a plurality of vertically spaced horizontal receptacles.

11 Claims, 5 Drawing Figures

DOCUMENT FILING APPARATUS

BACKGROUND OF THE INVENTION

This invention relates to an expandable filing apparatus employing similar box-like members and particularly for filing of relatively thin, single and multiple page units; for example, current insurance reports.

Documents such as business records and other papers have been commonly stored in folders in the drawers of steel filing cabinets. An improved storage system that affords maximum accessibility to the stored documents, in minimal space and without drawers, is shown in the copending application of Robert L. Rorex, entitled "DOCUMENT FILING ASSEMBLY" filed on the same day as this application and assigned to the same assignee. As more fully disclosed therein, box-like receptacles are secured in a staggered, vertical row and in overlapping face-to-face relationship to a supporting vertical wall by a base bracket. For convenience and accessibility, theoverlapping receptacles are tilted forwardly to expose the upper open ends of each receptacle. For example, the assembly may be tilted approximately twenty degrees from vertical. The receptacles include releasable interlocking elements such that the several receptacles similarly support another receptacle.

A wedge-shaped spacer having a forward face that is tilted outward is secured to the bracket. The uppermost of the overlapping receptacles has a rearward lip or hook flange at its upper end which hooks onto the spacer to maintain the uppermost receptacle at the desired tilt. Each of the rest of the receptacles has a similar rearward lip or hook flange which hooks onto the next higher receptacle in the row. The lower end of the spacer and each receptacle is supported by coupling to the bracket. The bracket is constructed to support a plurality of the receptacles.

The staggered box-like receptacles provide a significantly improved filing system particularly for current paper documents. The multiple component assembly may also require various manufacturing processes, for example, if a sheet metal racket assembly and paper or plastic receptacles are used. Further, the wall bracket is formed to support a plurality of the receptacles for the convenient sizing to each application and to provide for convenient expansion and contraction. However, when not filled, the exposed wall bracket does not generally create a particularly aesthetic decor. Further, the bracket construction does limit the total expansion.

SUMMARY OF THE PRESENT INVENTION

The present invention is particularly directed to such a multiple receptacle filing assembly and particularly to an integrated receptacle having releasable interlocking means to fully support each receptacle directly to each other. Generally, in accordance with this invention, a first wall mounted receptacle is provided with the next receptacles attached to such wall mounted receptacle by a releasable interlocking coupling to support the receptacle independently of the wall attachment or support for the first receptacle. Additional receptacles are similarly attached to the outermost receptacle. Thus, the receptacles may be identically formed and each assembly appears as a completed integrated unit. The expansion and contraction only changes the overall size without destroying this appearance. The support or coupling of this invention also results in a filing assembly which is only limited by the available wall space and not by a basic wall attachment unit or the like.

More particularly, in a preferred and unique embodiment of the present invention, each receptacle is formed as a generally rectangular box-like member sized to support paper documents and the like and having a lower support portion with an angulated back support wall and a generally extended front wall. The support portion is secured to the vertical wall means and thus mounts the first receptacle angularly oriented and spaced therefrom. Each such receptacle is formed with longitudinally extended interlocking means. A second receptacle is attached to the wall mounted receptacle by sliding the coupling element into the coupling element of the wall mounted receptacle. In a preferred construction, the back walls of the lower triangular end are aligned and in abutting engagement with the vertical wall means.

Generally, in a preferred construction, the wall support means includes a wall attachment means and first receptacle formed as an integrated element. The front wall of the wall support means includes an L-shaped interlock lip means along each edge with bottom stop walls and formed to interlock with similar complementing L-shaped lip means on the backside of a second receptacle which is, in turn, so constructed to support still another receptacle. The receptacles may thus be stacked to form a series with the open tops in vertical, spaced relation for convenient and ready access. The back walls may be essentially open except for the coupling L-shaped lip means.

An integrated plastic structure permits convenient mass production by any suitable molding technique.

The present invention has been found to preview an improved wall mounted filing assembly which may be constructed with an aesthetically pleasing appearance while providing high versatility in the size of any given installation.

BRIEF DESCRIPTION OF THE DRAWING

The drawing furnished herewith illustrates a preferred construction of the present invention in which the above advantages and features are clearly disclosed as well as others which will be readily understood from the following description of such illustrated embodiment.

In the drawing

DESCRIPTION OF THE ILLUSTRATED EMBODIMENTS

Figure 2:
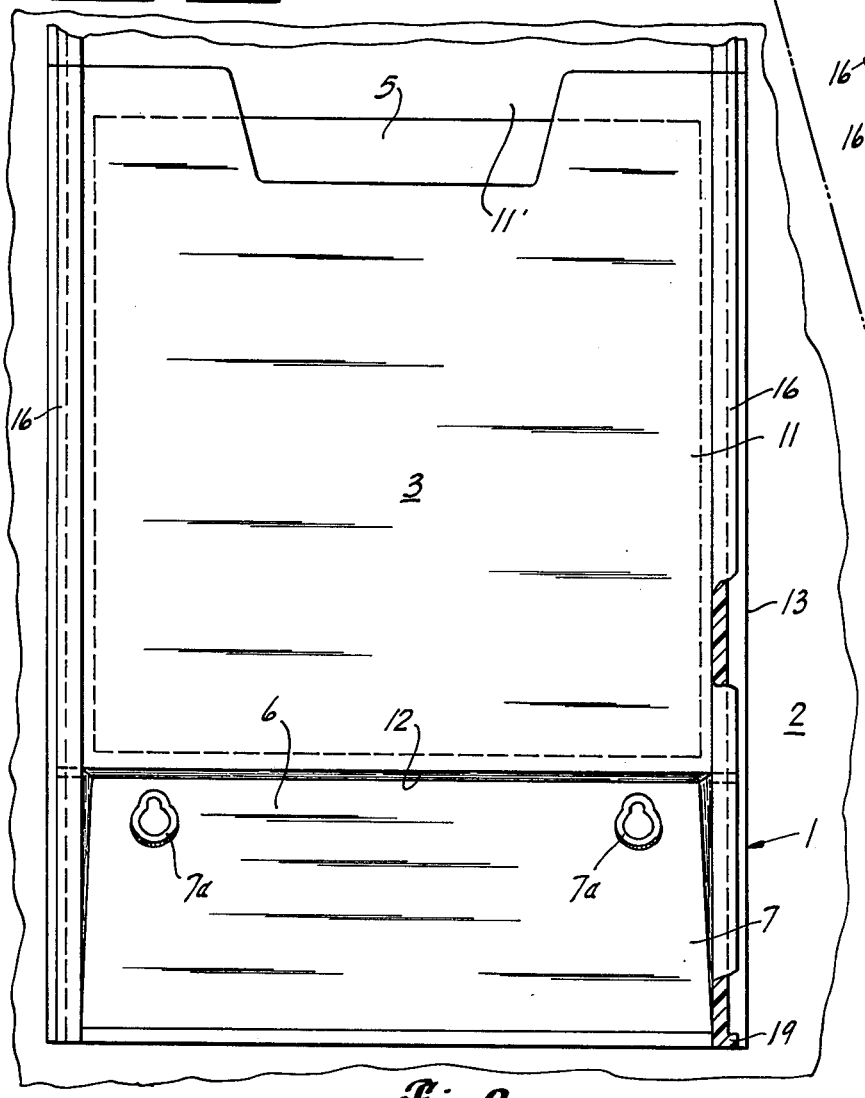
FIG. 2 is a front elevational view taken generally on line 2—2 of FIG. 1 with parts broken away and sectioned.
Figure 1:
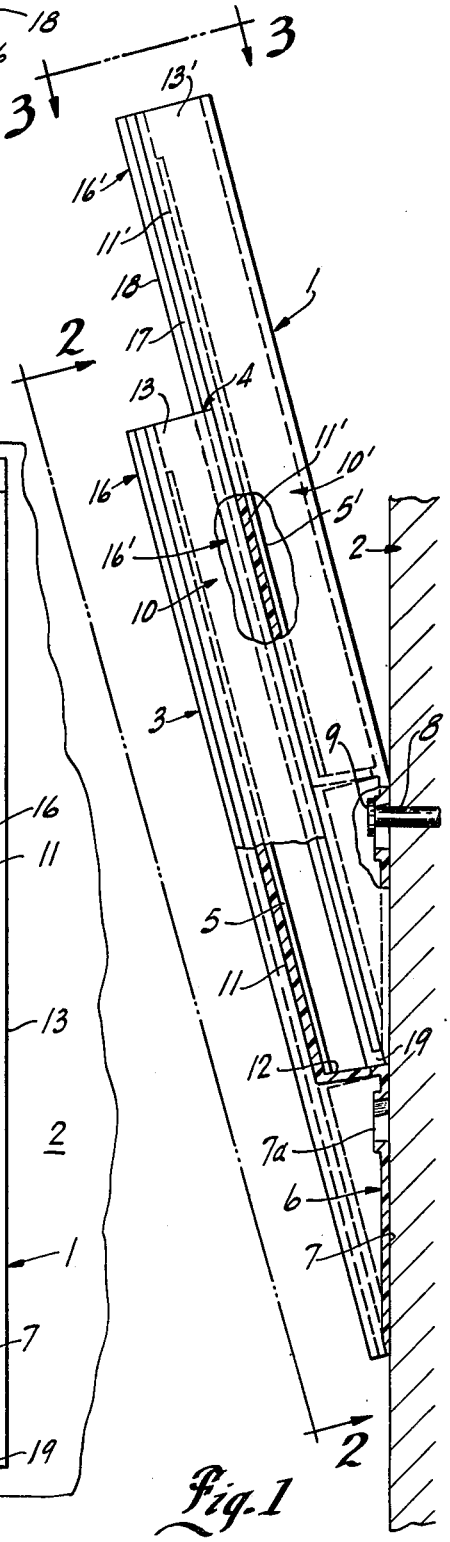
FIG. 1 is a side elevational view showing a plurality of paper tray units supported on a wall.

Referring particularly to FIG. 1, an integrated wall and first mounting and receptacle unit 1 is releasably mounted abutting the wall 2 and constructed to receive a second similar mounting and rectangular boxlike receptacle units 3 and releasably interconnected by a coupling means 4 integrally formed on units 1 and 3. Any number of units similar to units 1 and/or 3 can be similarly assembled as limited by the wall space to define a multiple pocketed storage arrangement in accordance with the teaching of the present invention. The units 1 and 3 are secured in abutting, vertically spaced relation with the upper ends thereof open for insertion and removal of paper documents 5. In the illustrated embodiment of the invention, the wall mounting unit 1 is shown formed of a suitable plastic having a lower triangular portion 6 defining a flat lower back mounting wall 7 secured abutting the wall 2. The portion 6 is shown as a recessed pocket with the lower back wall 7 integrally formed with integral sidewall portions forming an extension of the receptacle portions as presently described. The mounting portion, as shown most clearly in FIGS. 1 and 2, is provided with a pair of laterally spaced bayonet type openings *7a* which are adapted to move over a pair of headed pins 8 secured to the wall 2. The openings *7a* drop downwardly onto the head 9 of pins 8 which move into a narrow portion of the bayonet openings *7a* to affix and hang the mounting unit firmly abutting the wall 2.

Each of the receptacle units 1 and 3 is identically constructed and unit 3 is described with corresponding elements of unit 1 identified by corresponding primed numbers.

A first supporting box-like receptacle 10 is integrally formed with the mounting portion 6 and includes a front wall 11 which extends angularly upwardly therefrom in angularly spaced relation to the supporting wall 2. The bottom wall 12 of the receptacle is defined by the upper wall of the triangular shaped mounting portion 6 and in the assemblied relation is inclined as shown in FIG. 1.

The receptacle 10 includes similar sidewalls 13 integrally formed with the front wall 11 and extended normal to the front wall. The outer lateral edge portions of the receptacle front wall 11 and sidewalls 13 extend downwardly to the lowermost end of the triangular shaped mounting portion 6 with one part of coupling means 4 on said edge portions as presently described. The upper back wall is essentially open and formed by a pair of short inwardly projecting lips 14 extending laterally inwardly in a common plane from the opposite sidewalls 13, with the bottom wall 12 removed as at 15 in alignment with and extending inwardly from the lips 14.

Figure 3:
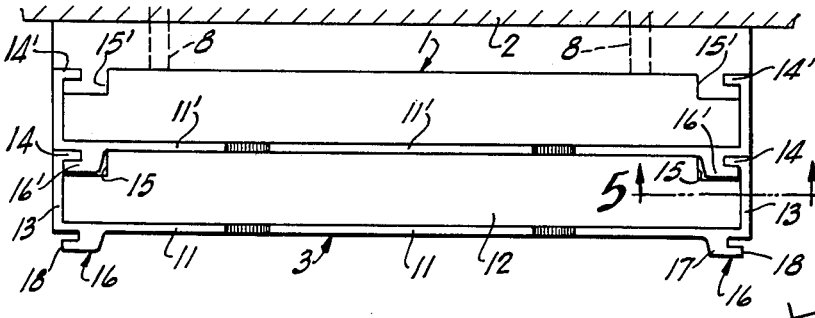
FIG. 3 is a top elevational view with parts broken away and sectioned to show detail of construction.
Figure 4:
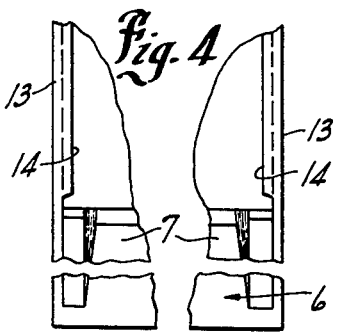
FIG. 4 is a fragmentary rear view of a receptacle unit.

The front wall 11 of the receptacle 10 includes similar L-shaped coupling channels or members 16 to the opposite side portions of the front wall 11. The front wall members 16 are adapted to complement and interlock with the interconnecting back wall lips 14 on the backside of the next immediately adjacent receptacle to form the releasable coupling means 4. When so assembled, front wall forms a closing back wall to the supported receptacle, as shown in FIGS. 1 and 3. However, the inclined mounting also insures proper location of the documents 5 within the first or wall mounted receptacle 1.

Figure 5:
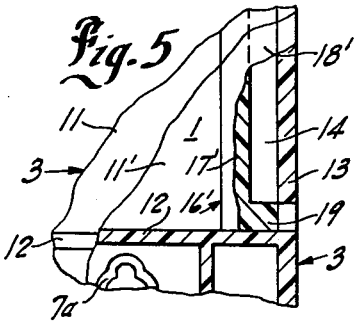
FIG. 5 is an enlarged fragmentary front view taken generally on line 5—5 of FIG. 3.

More particularly, as most clearly shown in FIGS. 3 and 5, the front wall mounting members 16 are shown integrally formed with the front wall 11. Each member 16 is generally an L-shaped member including a relatively heavy support leg 17 secured to the front wall 11 in inwardly spaced relation to the sidewall 13 and in proper relation to the coupling back wall lips 14 to accommodate such lip. The member 16 includes an outer leg 18 projecting from the support leg 17 in spaced relation to the front wall 11 and terminating generally in alignment with the interior surface of the sidewall 13 to again accommodate an adjacent back wall lip 14. The lower end of each member 16 includes a stop member or portion 19 which is engaged by the lower end of the lip 14 to positively limit the downward movement of an outer receptacle 3. Although wall 2 also acts as a stop, the member 19 establishes a positive and direct interlock which can be conveniently provided.

Each outer receptacle unit 3 thus directly interlocks with the front mounting or anchor members 16 by telescoping of the back wall lips 14 downwardly over the mounting members. The outer receptacle unit 3 drops downwardly of unit 1 until stop portion 19 is engaged or the lower inclined wall portion 7' moves into abutting engagement with the wall 2. The lower triangular portion 6' moves below the preceding receptacle unit 1 as it moves into engagement with the wall 2 and is located immediately adjacent to the inner receptacle unit 1.

The upper end of the successive receptacles 10' of unit 3 will thus drop below the open top of the immediately preceding receptacle 10 of unit 1. A notched portion 20 is shown in the upper portion of each front wall 11 and 11' of the interconnected receptacle units 1 and 3 for convenient access to documents 5. The illustrated central notch or recess has a width approximately one-half the width. It thus provides a substantial opening with exposure of the upper end portions of the paper or other document 5 stored with the receptacle.

The depth of each receptacle 10 from the bottom wall 12 to the uppermost open end is designed for a particular range of documents. For example, for conventional letter sized documents the depth of the receptacle will normally be on the order of nine inches such that the conventional 8 ½ by 11 document will conveniently fit within the receptacle.

Paper receptacles may be readily added to an incomplete vertical row until the vertical row is completed. Thus, to add a paper receptacle 10 to the row of paper receptacles in FIG. 1, it is a simple matter to telescope the back wall lips 14 of the additional paper receptacle over the forward L-shaped members on the exposed front wall of the next lowermost mounted receptacle 3. The receptacle would move downwardly until engaging of the stop portion 19 or its lower back wall 7' abutts the supporting wall, as shown for the second receptacle 3 in FIG. 1.

Further, with the illustrated integrally formed mounting and connecting means a stack of receptacles may be mounted to or rest upon a suitable horizontal surface. Thus, the outer or upper receptacles in a horizontal stack can be arranged with the open edges in or near alignment.

The invention provides a series of thin box-like receptacles adapted to be mounted in a vertically stacked row and further includes integral mounting and locating means to angularly orient the stacked row of receptacles from the vertical support wall for increased visibility and accessibility of the documents or other stored material. The receptacles may be formed of a suitable plastic by molding or the like.

The present invention thus provides a simple and sturdy filing receptacle for convenient filing of current documents and having good aesthetic appearance and readily manufactured.

Various modes of carrying out the invention are contemplated as being within the scope of the following claims, particularly pointing out and distinctly claiming the subject matter which is regarded as the invention.

I claim

1. A document filing apparatus for filing documents and the like for mounting upon a vertical support means, comprising a first document support receptacle having an opening at the upper portion to receive papers for filing mount means secured to the lower end of said receptacle for supporting said receptacle in a generally vertical position on said vertical support means with the receptacle in a forwardly tilted position to facilitate access to the upper opening, two part receptacle coupling means, said receptacle having a first part on a first portion of said receptacle and a second part on a second portion of said receptacle, said coupling parts being arranged whereby a second receptacle having said first and second parts of the coupling means may be releasably attached to the first receptacle by coupling of the first part of one receptacle to the second part of the other receptacle, said coupling means holding said receptacles in face-to-face relationship to hold the outer receptacle to the first receptacle and thereby supporting said receptacles in vertical offset relation with both of the receptacles in said forwardly tilted position, said mount means of the first of said receptacles being a wedge-shaped member having V-shaped sidewalls and includes a wedge-shaped bottom portion having partial front walls on the opposite sides of the receptacle extending downwardly as an extension of said receptacle and an offset mounting wall along the inner edges of said sidewalls and set inwardly of said front walls to define the angular orientation of the receptacles, whereby a plurality of said receptacles have the mounting walls aligned and abutting the support means.

2. In the assembly of claim 1 wherein said releasable coupling means includes similar laterally spaced and longitudinally extended parts on the front wall and the back wall of said receptacles.

3. In the wall filing assembly of claim 3 wherein said front wall includes L-shaped projections extending from the outer portion of the front wall with outwardly projecting legs, said back wall consisting of a pair of inwardly projecting lips on the outermost edges for mating with said legs.

4. In the assembly as set forth in claim 1, in which the receptacles are generally rectangular box-like elements having an open top, a front wall and a back wall, said coupling means including longitudinally extended pin and slot coupling parts, said first part of coupling means being formed on the outer edge portions of the front wall of the receptacles and said second part of the coupling means being formed on the outer edge portion of the back wall of said receptacles.

5. The assembly of claim 1 wherein said coupling parts are mechanically telescoping, elongated, interlocking complementary parts extending along the vertical extent of the receptacles, said parts being engageable by lowering of the second part into the first part until the lower end of the outer receptacle is aligned with the lower end of the inner receptacle.

6. A receptacle for filing of documents and the like permitting releasable interengagement of like receptacles comprising a rectangular housing formed of plastic and having an essentially continuous front wall means and a substantially completely open back wall means integrally connected by an integral sidewall means and a bottom wall means, said back wall means having a substantially complete opening between the sidewall means, a bottom extension portion of said housing having an angularly offset mounting wall integrally formed with the inner end of the bottom wall means, said mounting wall being generally flat wall for securement to a flat supporting wall, said back wall means having a first pair of releasable coupling elements projecting laterally across from the opposite sides of the opening in the back wall means in a common plane and forming a first part of a two piece releasable coupling means said front wall having a second pair of releasable coupling elements extending laterally from the opposite sides of the receptacles in a common plane and forming a second part of said two piece releasable coupling means, said first and second releasable coupling elements being located on said walls and including interengaging portions with a pair of the receptacles aligned into a row to interconnect and locate the receptacles relative to each other with said front wall of one receptacle forming a back wall of the adjacent interconnected receptacle.

7. The receptacle of claim 6 wherein said first and second releasable coupling elements are similarly located on the outer vertical edges of said front and back walls of ther receptacle and include interengaging means limiting the vertical movement of the second receptacle relative to the first receptacle.

8. The receptacle of claim 7 wherein said coupling elements on said front wall include forwardly projecting L-shaped members one each along the opposite side edges with outer opposed legs terminating inwardly of the outer surfaces of the sidewalls and inwardly projecting members on said back wall means interengaged with L-shaped members to laterally align and support interconnected receptacles.

9. The receptacle of claim 8 wherein said bottom wall means of the receptacle extends outwardly and downwardly from the mounting wall.

10. A receptacle for filing of documents and the like comprising a rectangular plastic housing having a front wall integrally formed with opposite sidewalls and a bottom wall and a pair of inwardly extending back wall members extending inwardly from said sidewalls to form a substantially open back wall, said front wall having edge coupling elements forming a first pair of a two piece releasable coupling means, each of said edge coupling elements including an L-shaped member having a first leg parallel to said sidewalls and set inwardly of said sidewalls and having an outer leg extending from said first leg parallel to the front wall and outwardly of said first leg and terminating inwardly of the sidewalls, said back wall members mating with said L-shaped members and forming a second part of said two piece releasable coupling means whereby said sidewalls are located in abutting and coplanar relationship with a pair of the receptacles connected in a row and means for mounting the receptacles in an angled position to a vertical support structure with the top end located forwardly of the bottom wall.

11. The receptacle of claim 10 having a mounting wall secured to the bottom wall, said bottom wall of the receptacle extending outwardly and downwardly of said mounting wall.

* * * * *

UNITED STATES PATENT AND TRADEMARK OFFICE

CERTIFICATE OF CORRECTION

PATENT NO. : 4,062,452

DATED : December 13, 1977

INVENTOR(S) : ALLAN E. BARTHOLOMEW

It is certified that error appears in the above-identified patent and that said Letters Patent are hereby corrected as shown below:

| | | | | |
|---|---|---|---|---|
| Column | 1, | Line | 43, | after "metal" cancel "racket" and insert --- bracket ---; |
| Column CLAIM 3 | 5, | Line | 39, | after "claim" cancel "3" and insert --- 2 ---; |
| Column CLAIM 5 | 5, | Line | 54, | after "claim" cancel "1" and insert --- 4 ---; |
| Column CLAIM 7 | 6, | Line | 26, | after "of" cancel "ther" and insert --- the ---; |
| Column CLAIM 8 | 6, | Line | 34, | after "with" insert --- said ---; |
| Column CLAIM 10 | 6, | Line | 46, | after "first" cancel "pair" and insert --- part ---. |

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*